US006264257B1

(12) United States Patent
Meinke

(10) Patent No.: US 6,264,257 B1
(45) Date of Patent: Jul. 24, 2001

(54) MOTOR VEHICLE DOOR HANDLE ASSEMBLY

(75) Inventor: Joseph Meinke, Gowen, MI (US)

(73) Assignee: ADAC Plastics, Inc.

( * ) Notice: Subject to any disclaimer, the term of this patent is extended or adjusted under 35 U.S.C. 154(b) by 0 days.

(21) Appl. No.: 09/415,413

(22) Filed: Oct. 8, 1999

(51) Int. Cl.[7] ..... E05B 3/00
(52) U.S. Cl. ..... 292/336.3; 292/348
(58) Field of Search ..... 292/336.3, 348, 292/DIG. 23, DIG. 62, DIG. 25

(56) References Cited

U.S. PATENT DOCUMENTS

| | | | | |
|---|---|---|---|---|
| 3,025,091 | * | 3/1962 | Peras | 292/139 |
| 4,363,231 | * | 12/1982 | Kaveney | 70/484 |
| 4,763,934 | * | 8/1988 | Kaveney | 292/21 |
| 4,835,997 | * | 6/1989 | Akright | 70/141 |
| 4,986,576 | * | 1/1991 | Anderson | 292/40 |
| 5,005,885 | | 4/1991 | Kobayashi et al. . | |
| 5,096,239 | * | 3/1992 | Rippberger | 292/128 |
| 5,106,135 | | 4/1992 | Menke et al. . | |
| 5,263,751 | | 11/1993 | Priest et al. . | |
| 5,605,363 | * | 2/1997 | Kapes | 292/196 |
| 5,676,003 | | 10/1997 | Ursel et al. . | |
| 5,681,068 | | 10/1997 | Kleefeldt et al. . | |
| 5,697,236 | | 12/1997 | Kleefeldt et al. . | |
| 5,743,575 | * | 4/1998 | Mcfarland | 292/336.3 |

* cited by examiner

*Primary Examiner*—Gary Estremsky
(74) *Attorney, Agent, or Firm*—Young & Basile

(57) ABSTRACT

A motor vehicle door assembly comprising an outside door handle, an outside door handle linkage for connecting the outside door handle to a door latch, an inside door handle, and an inside door handle linkage for connecting the inside door handle to the door latch. The inside and outside door handle linkages are arranged to share many common elements whereby to reduce the overall cost of the total door handle assembly by virtue of reduced parts costs and reduced labor. Specifically, the inside and outside door linkages share a common spring to provide a positive return movement of the handles to the rest position; share a common latch actuator lever to simplify the overall assembly; and share a common damper mechanism to dampen the closing movement of the inside and outside door handles as they are released following an unlatching action.

21 Claims, 5 Drawing Sheets

MOTOR VEHICLE DOOR HANDLE ASSEMBLY

FIELD OF THE INVENTION

This invention relates to motor vehicle door handle assemblies and, more particularly, to a simplified assembly providing both inside and outside door handle assembly functions.

BACKGROUND OF THE INVENTION

Motor vehicle door assemblies typically include an outside door handle assembly, an outside door handle linkage for connecting the outside door handle to the door latch, an inside door handle, and an inside door handle linkage for connecting the inside door handle to the door latch. Whereas this basic arrangement is satisfactory in providing opening of the door from either inside or outside of the door, the total door handle assembly tends to be rather complex and rather expensive both from a materials standpoint and a labor/assembly standpoint.

SUMMARY OF THE INVENTION

This invention is directed to the provision of improved motor vehicle door handle assembly.

More particularly, this invention is directed to the provision of a motor vehicle door handle assembly wherein the outside door handle assembly and the inside door handle assembly share common elements to simplify the construction and operation of the overall assembly and reduce the overall materials and labor cost of the assembly.

The invention is directed to a motor vehicle door handle assembly comprising an outside door handle, an outside door handle linkage for connecting the outside door handle to a door latch, an inside door handle, and an inside door handle linkage for connecting the inside door handle to the door latch.

According to the invention, the outside and inside door handle linkages share a common spring element which is interposed in each linkage and acts to yieldably resist opening movement of the inside and outside door handles and provide a spring biased return movement of the inside and outside door handles upon release of the handles. This arrangement simplifies the overall construction of the total door handle assembly without any sacrifice in the performance of either the inside or the outside door handle assembly.

According to a further feature of the invention, the outside and inside door handle linkages further share a common damper mechanism which is interposed in each linkage and acts to cushion the spring biased return movement of the door handles. With this arrangement, a single damper mechanism acts to provide a soft, cushioned return of either the outside or the inside door handle to its rest position upon release of the handle.

According to a further feature of the invention, the assembly further includes a lost motion means allowing movement of either door handle to an open position without corresponding opening movement of the other door handle. This arrangement allows the utilization of shared componentry as between the inside and outside door handle assemblies without causing interference between the operation of the inside and outside door handles.

According to a further feature of the invention, the outside door handle linkage and the inside door handle linkage further share a common latch actuator element positioned at a location remote from the latch and a common linkage element for interconnecting the latch actuator element and the latch; and the common latch actuator element is moved to actuate the common linkage element and thereby actuate the latch in response to opening movement of either the outside door handle or the inside door handle. This arrangement further simplifies the overall construction of the total door handle assembly without sacrifice of handle performance.

According to a further feature of the invention, the common spring element resiliently resists movement of the common latch actuator element in an unlatching direction in response to opening movement of the outside door handle or the inside door handle and returns the common latch actuator to a rest position upon release of the actuated handle. This common spring arrangement further simplifies and reduces the cost of the total door handle assembly.

According to a further feature of the invention, the common latch actuator element comprises a latch lever mounted for pivotal movement about a fixed axis; the common spring element comprises a coil spring centered on the axis and resisting movement of the latch lever in an unlatching direction; and the assembly further includes a common damper mechanism including a housing containing a viscous fluid and a vane movable in the housing against the resistance of the viscous fluid in response to pivotal movement of the latch lever. This arrangement allows the common latch lever to actuate the latch, mount the spring, and drive the damper mechanism.

According to a further feature of the invention, the common damper mechanism further includes a gear driving the vane and the latch lever includes gear teeth formed on the lever concentric with the axis and driving the gear. This arrangement provides a simple means of actuating the damper utilizing the pivotal movement of the latch lever.

According to a further feature of the invention, the outside door handle linkage includes an outside linkage lever pivotally mounted at one end thereof proximate the remote location for pivotal movement about a fixed axis and operatively connected proximate a free end thereof to the outside door handle; the latch lever is pivotally mounted at one end thereof on the axis and is operatively connected to the inside door handle and to the shared common linkage element; and the lost motion means includes a first lost motion connection between the one ends of the levers operative to allow relative pivotal movement between the levers. This arrangement provides a simple means of driving the latch lever either from the outside door handle or from the inside door handle.

According to a further feature of the invention, the first lost motion connection provides a driving connection between the levers in response to opening movement of the outside door handle and allows relative movement between the levers in response to opening movement of the inside door handle so as not to disturb the outside door handle.

According to a further feature of the invention, the lost motion means further includes a second lost motion connection between the latch lever and the inside door handle whereby pivoting of the latch lever in response to opening movement of the outside door handle does not disturb the inside door handle.

According to a further feature of the invention, the inside door handle linkage includes a linkage element; the second lost motion connection comprises a mounting structure on the latch lever remote from the pivot axis slidably receiving one end of the inside door handle linkage element; and the one end of the inside door handle linkage element is headed so as to allow unlatching movement of the latch lever in response to opening movement of the inside door handle while not disturbing the inside door handle in response to unlatching movement of the latch lever in response to opening movement of the outside door handle.

DETAILED DESCRIPTION OF THE PREFERRED EMBODIMENT

Figure 1:
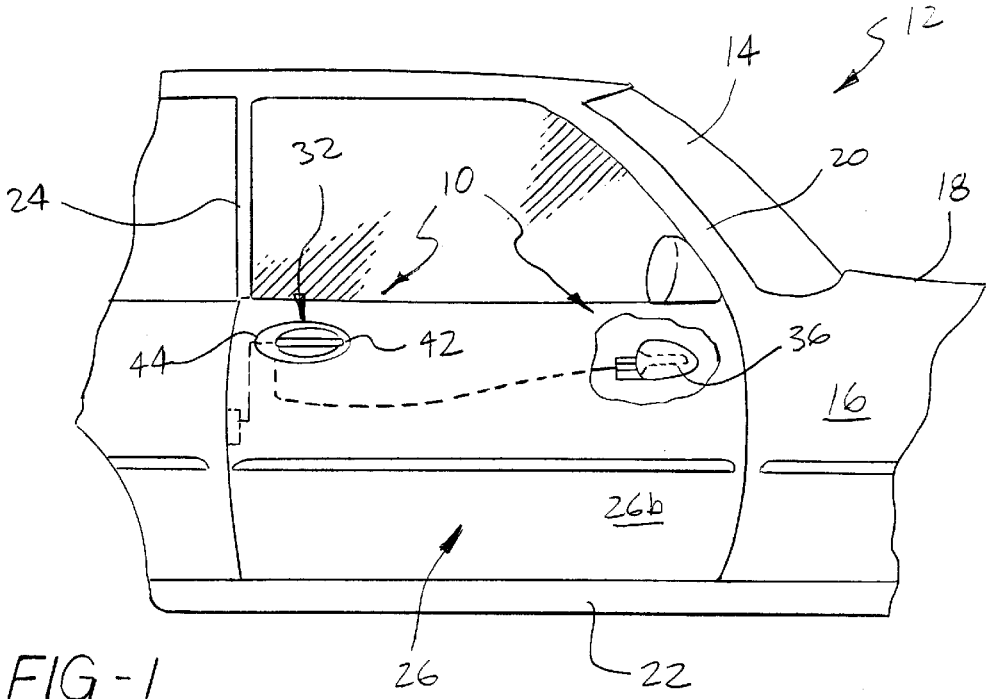
FIG. 1 is a fragmentary view of a motor vehicle including a door embodying the door handle assembly of the invention.

The invention door handle assembly 10 is seen in FIG. 1 in association with a fragmentarily shown motor vehicle 12 including a windshield 14, a front quarter panel 16, a hood 18, an A pillar 20, a sill 22, a B pillar 24, and a door 26 positioned in the door opening defined by the A pillar 20, front quarter panel 16, sill 22, and B pillar 24.

Figure 2:
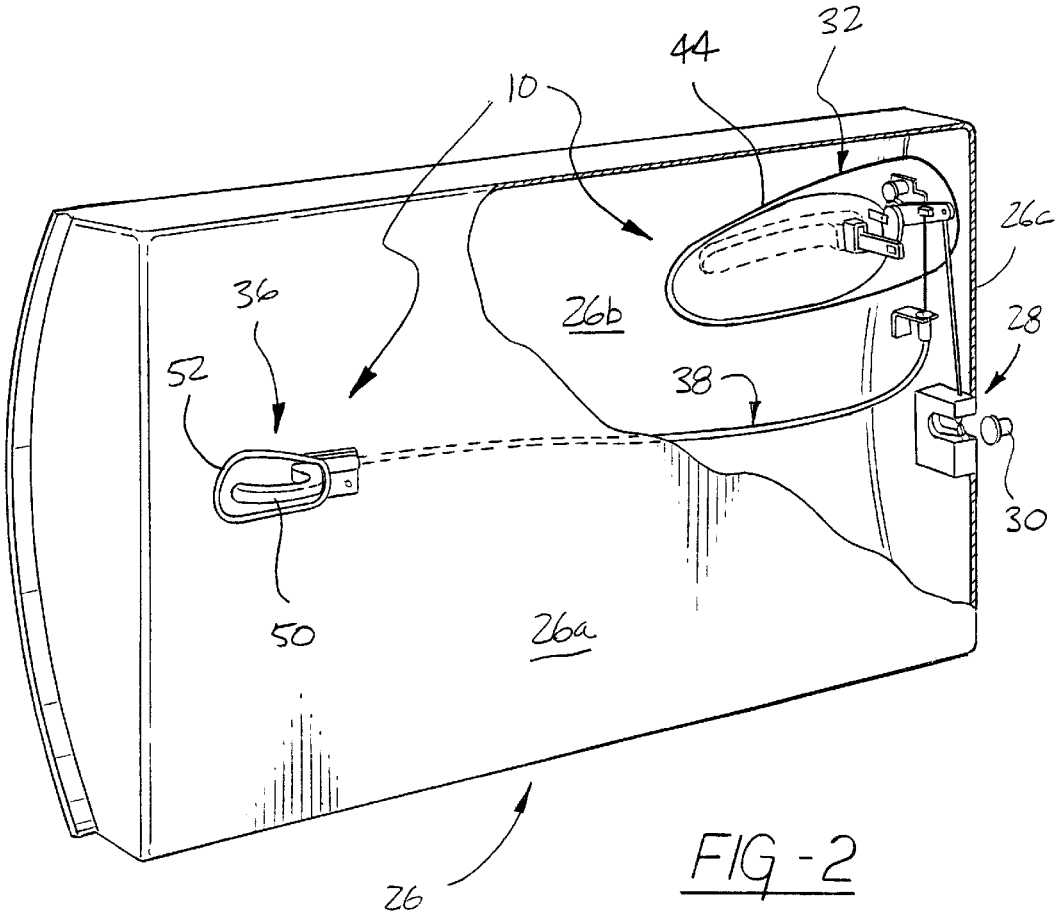
FIG. 2 is a perspective, somewhat schematic view of the motor vehicle door seen in FIG. 1.

Door 26 (FIG. 2) includes an inner skin 26*a*, an outer skin 26*b*, and a latch 28 mounted on a shut face 26*c* of the door and arranged for coaction in known manner with a bolt or striker 30 mounted on the B pillar 24.

Figure 3:
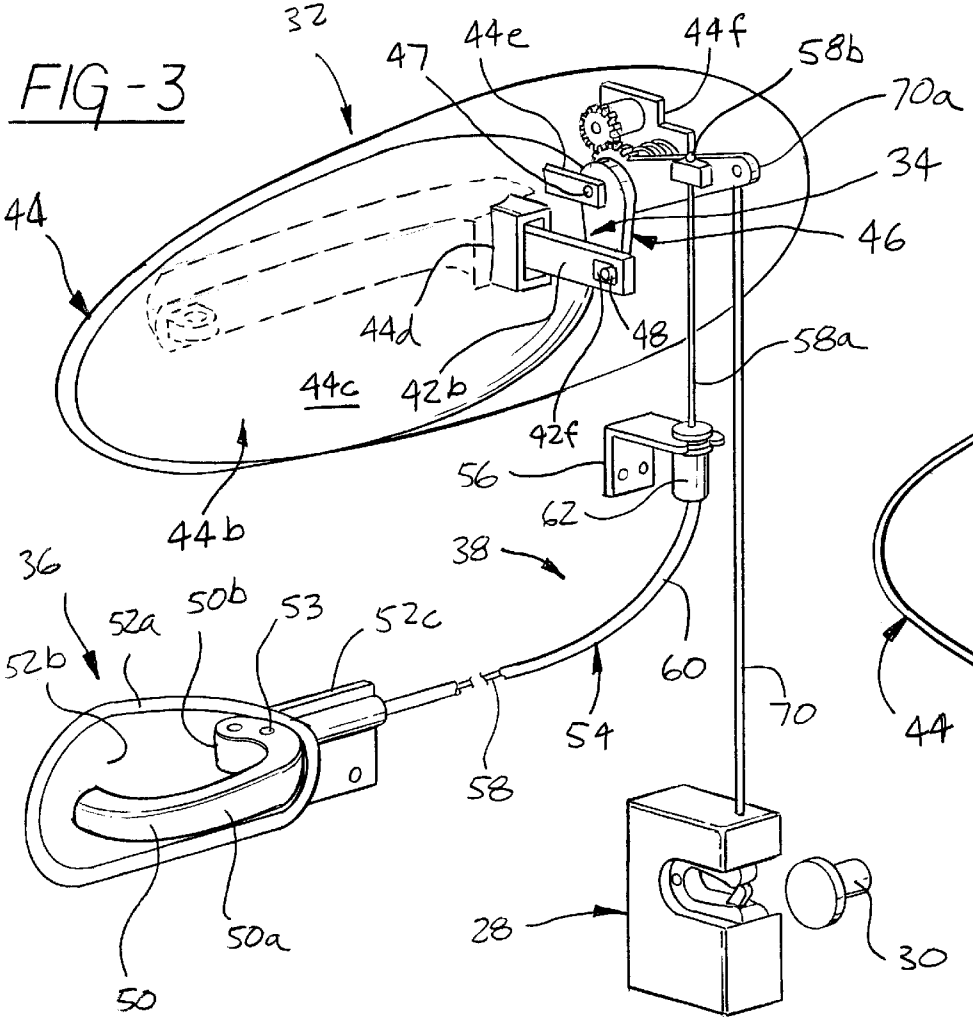
FIG. 3 is a perspective view of the door handle assembly of the invention.
Figure 6:
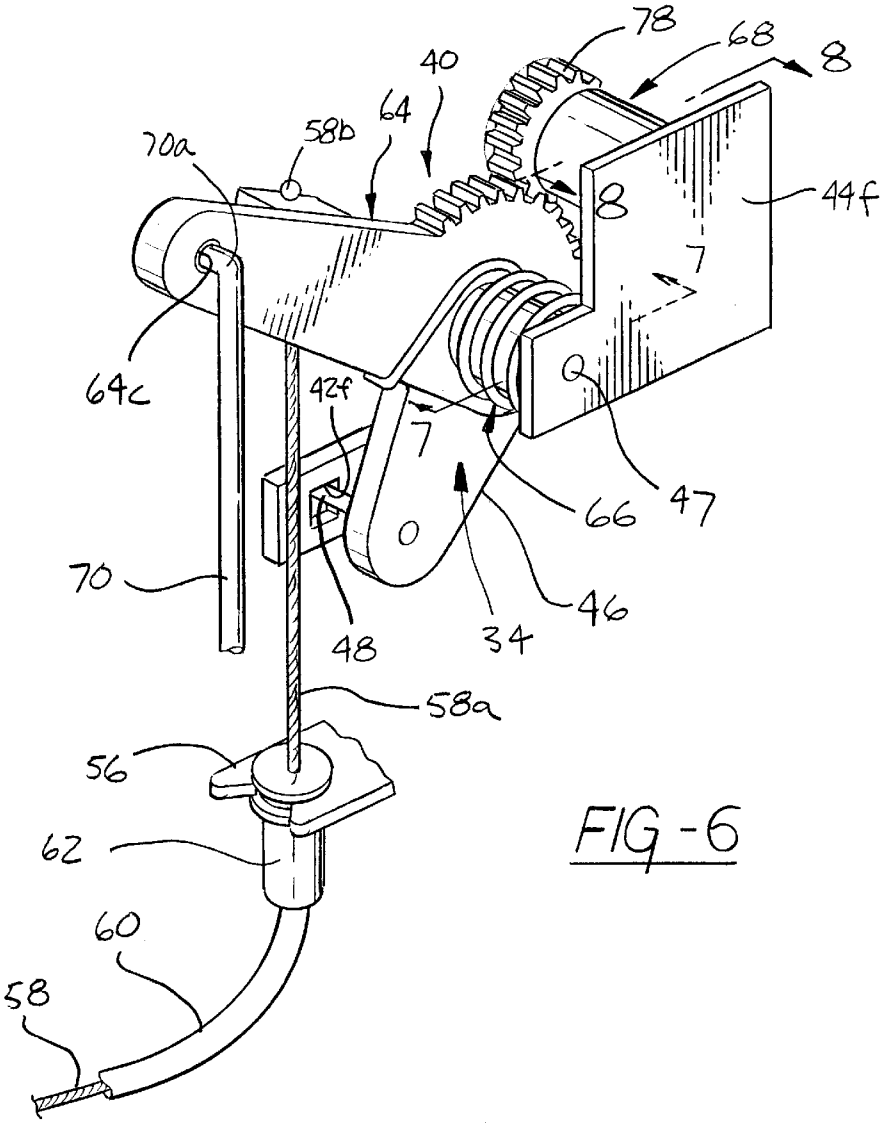
FIG. 6 is a perspective, fragmentary view of a common latch actuator mechanism employed in the invention door handle assembly.

Motor vehicle door handle assembly 10 (see also FIG. 3) includes an outside door handle assembly 32, an outside door handle linkage 34, an inside door handle assembly 36, an inside door handle linkage 38, and a common latch actuator assembly 40.

Figure 4:
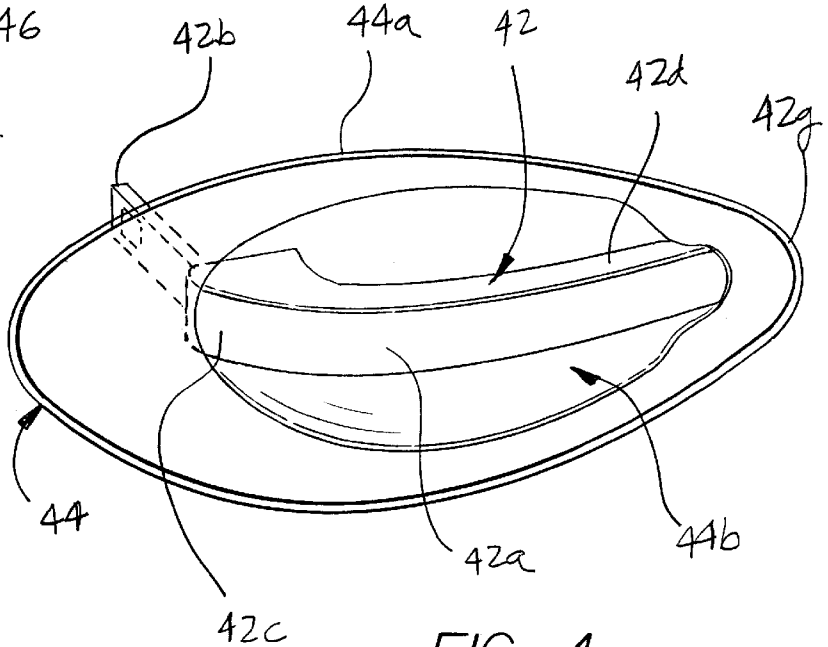
FIG. 4 is a perspective view of an outside door handle assembly employed in the door handle assembly of the invention.
Figure 5:
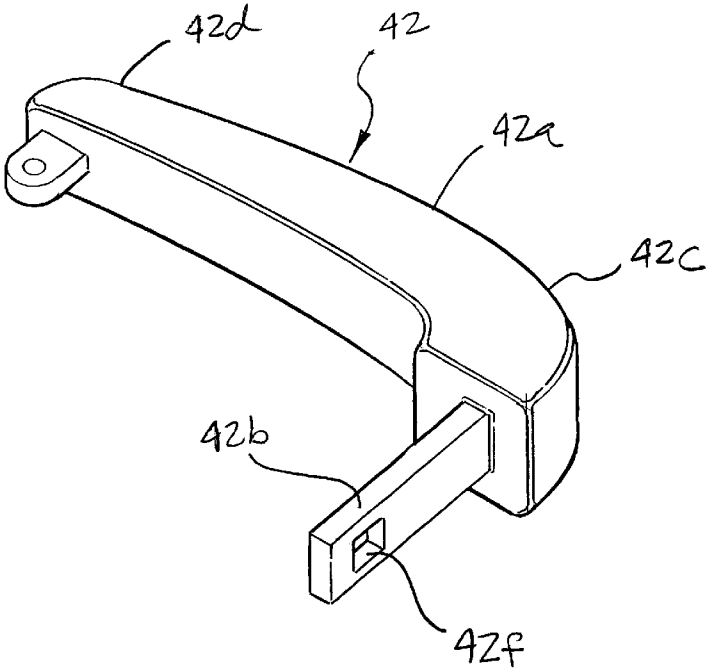
FIG. 5 is a perspective view of an outside door handle employed in the outside door handle assembly.
Figure 7:
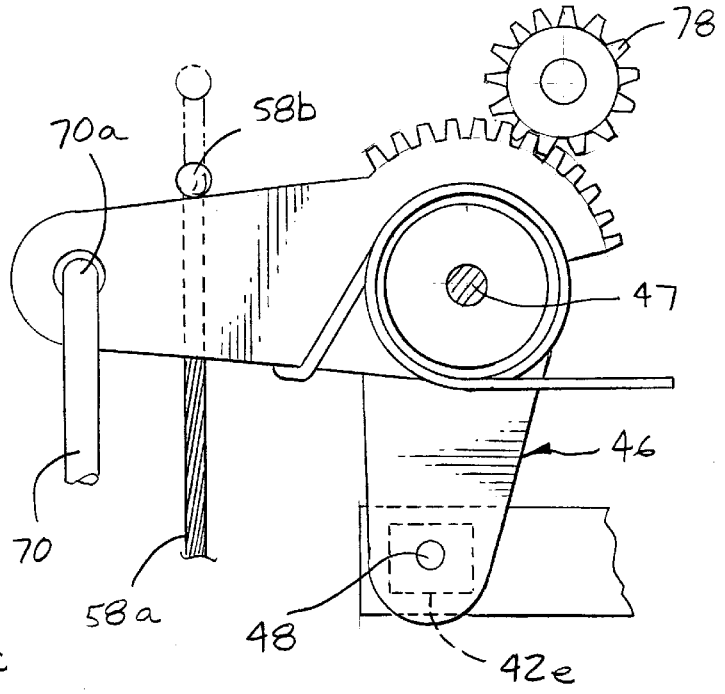
FIGS. 7 and 8 are cross-sectional views taken respectively on lines 7—7 and 8—8 of FIG. 6.
Figure 8:
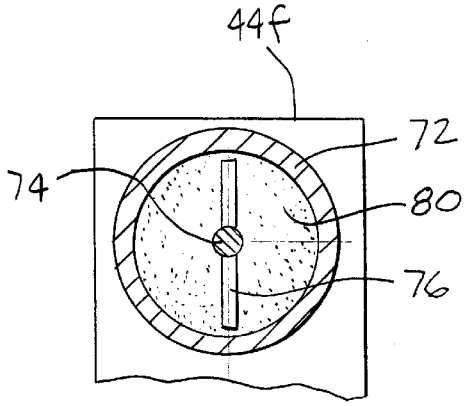
Figure 9:
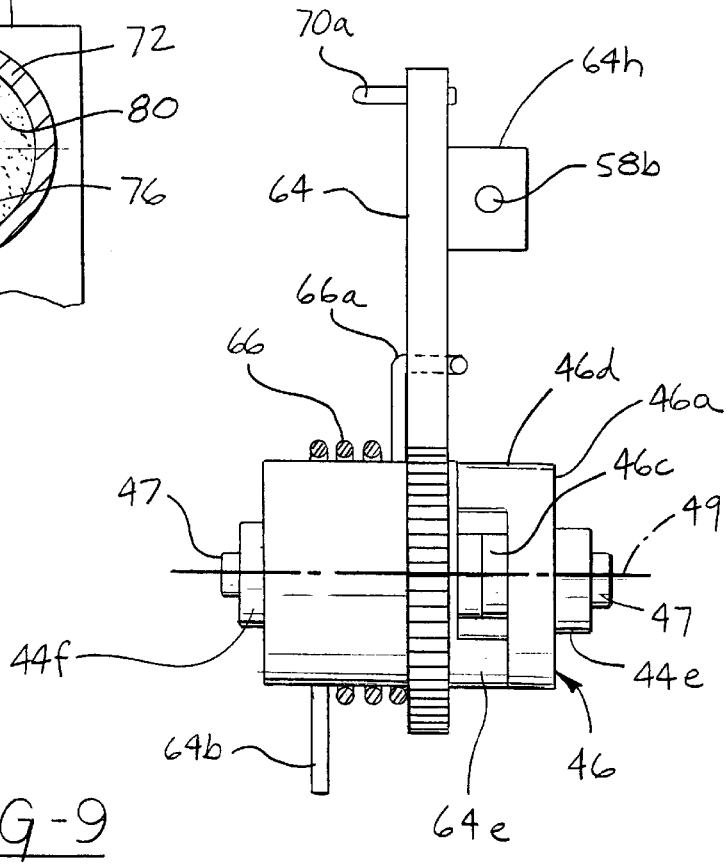
FIG. 9 is a fragmentary plan view of the common latch actuator mechanism.
Figure 10:
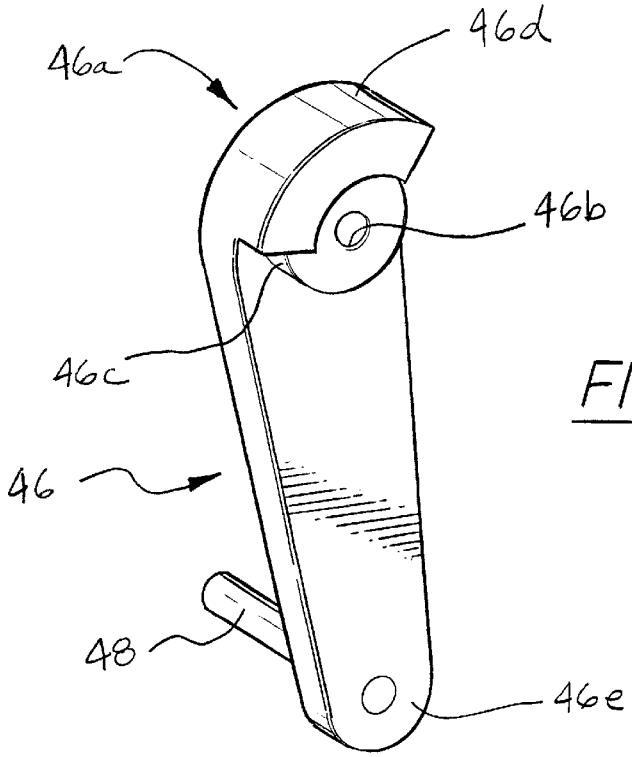
FIGS. 10 and 11 are detail perspective views of elements employed in the common latch actuator mechanism.
Figure 11:
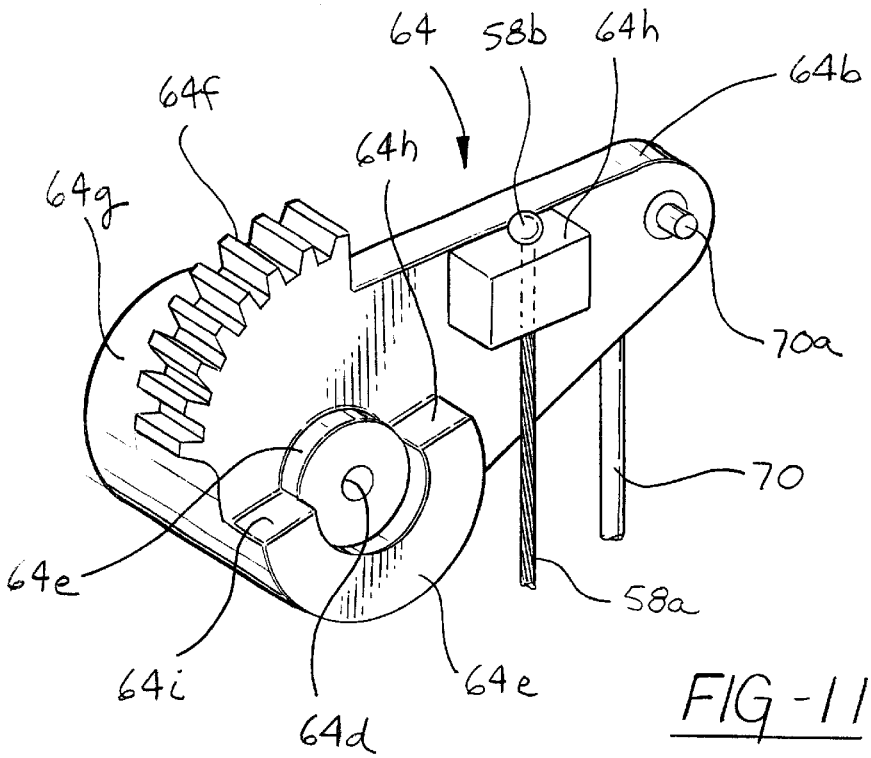

Outside door handle assembly 32 (FIGS. 3, 4 and 5) includes a handle 42 and a housing or escutcheon 44.

Housing 44 is mounted in a suitable opening in the outer skin 26*b* of the door and has a generally oval configuration. Housing 44 includes a peripheral rim portion 44*a* surrounding a central recessed bowl portion 44*b*. The inner face 44*c* of the housing defines an inwardly projecting hollow guide portion 44*d* and spaced pillar portions 44*e* and 44*f*.

Handle 42 has an elongated configuration and includes a main body grip portion 42*a* and an arm portion 42*b* extending inwardly from a rear end 42*c* of the handle. Front end 42*d* of the handle includes a pivot portion 42*e* for pivotally mounting the handle in known manner to the front end 44*g* of the housing, and the arm 42*b* extends inwardly and slidably through guide portion 44*d* of the housing to dispose an opening 42*f* at the free end of arm portion 42*b* within the interior of the door.

Outside door handle linkage 34 (FIGS. 6, 7, 9 and 10) comprises a lever 46 and a pin 48.

Lever 46 is pivotally mounted at one end 46*a* thereof on a pivot pin 47 extending between the inner ends of housing pillars 44*e* and 44*f*. The end 46*a* of lever 46 is configured to define a through bore 46*b* receiving pivot pin 47, a hub or journal portion 46*c* centered on bore 46*b*, and an arcuate driver portion 46*d* centered on bore 46*b* outwardly of hub 46*e*. Arcuate driver portion 46*f* may have an arcuate extent of, for example, 110° and has an axial extent exceeding the axial extent of hub portion 46*b* so that arcuate driver portion 46*d* overhangs hub portion 46*c*.

Pin 48 is fixedly secured to the other end 46*e* of lever 46 and extends in a direction opposite to the extent of hub portion 46*c* and driver portion 46*d*. Pin 48 is received in the opening 42*f* of arm portion 42*b* of handle 42 so that pivotal movement of the handle about its front end 42*d* has the effect, via the driving interconnection between pin 48 and opening 42*e*, of pivoting lever 46 about the fixed axis 49 defined by pin 47.

Inside door handle assembly 36 (FIGS. 2 and 3) includes a handle 50 and a housing or escutcheon 52.

Housing 52 is fixedly secured in a suitable opening in the inner skin 26*a* of the door and defines a main body portion 52*a*, defining a central concavity 52*b*, and a cable mounting portion 52*c*.

Handle 50 is suitably mounted in the concavity 52*b* of main body housing portion 52*a* for pivotal movement about a pivot pin 53 carried by housing 52 and includes a gripping portion 50*a* for grasping by the vehicle operator and a cable attachment end portion 50*b*.

Inside door handle linkage 38 (FIGS. 2, 3 and 6) includes a cable assembly 54 and a bracket 56.

Cable assembly 54 is of the Bowden type and includes a central core or cable 58, an outer sheath 60, and a fitting 62.

Bracket 56 is fixedly secured to the inner skin 26*a* of the door at a location proximate the outside door handle assembly and fitting 62 is fixedly secured at the outboard end of the bracket and extends downwardly from the bracket.

Sheath 60 is fixedly secured at one end in the lower end of fitting 62 and at its other end in the mounting portion 52*c* of the inside door handle housing 52.

Cable 58 is connected at one end to inside handle cable attachment portion 50*b* and extends through housing mounting portion 52*c*, through sheath 60, and through fitting 62 to define an upper cable end 58*a* extending upwardly from fitting 62 and defining a head 58*b* at its upper free end. It will be seen that pivotal opening and closing movement of inside door handle 50 has the effect of sliding cable free end 58*a* upwardly and downwardly within fitting 62.

Common latch actuator assembly 40 (FIGS. 6, 7, 8, 9 and 11) includes a latch actuator lever 64, a spring element 66, and a damper mechanism 68.

Latch actuator lever 64 includes an inner end 64*a* and an outer end 64*b*. Outer end 64*b* includes an aperture 64*c* for receipt of the upper end 70*a* of a latch actuator rod or linkage 70. The inner end 64*a* of the lever is configured to define a central bore 64*d* for receipt of pivot pin 47, a hub or journal portion 64*e* centered on central bore 64*d*, and an arcuate driver portion 64*e* centered on hub portion 64*d* outwardly of hub portion 64*e*, and a gear segment 64*f* centered on bore 64*d* at a location circumferentially removed from driver portion 64*e*. Driver portion 64*e* may have an arcuate extent, for example, of 180° and has an axial extent exceeding the axial extent of hub portion 64*e* so that the arcuate driver portion extends axially beyond the hub portion. Lever 64 further defines a spring mount hub portion 64*g* concentric with bore 64*d* and through which pivot pin 47 extends for mounting in housing pillar 44*f*. Lever 64 further includes a mounting structure 64*h* positioned between inner and outer ends 64*a* and 64*b* and having a central bore sized to slidably receive the upper end 58*a* of cable 58. The headed end 58*b* of the cable precludes separation of the cable from the mounting portion 64*h*, provides a driving connection between the cable and the lever 64, and allows lost motion between the cable and the lever 64.

In the assembled relation of levers 46 and 64, pivot pin 47 passes centrally through aligned bores 46*b* and 64*d*, hub portions 46*c* and 64*e* slidably interface, and arcuate driver portion 46*d* is located circumferentially within the missing arcuate portion of arcuate driver portion 64*e*. It will be seen that driver portions 46*d* and 64*e* allow driving movement of lever 46 with respect to lever 64 in one direction while allowing lost motion movement between lever 64 and 46 in the opposite direction.

Spring element 66 comprises a coil spring and is mounted on spring mount portion 64*g* of lever 64 with one end 66*a* of the spring hooked under the lower edge of lever 64 and the other end 64*b* of the spring suitably anchored with respect to outer door handle housing 44. Spring 66 acts to resist downward pivotal movement of lever 64 about axis 49 and returns lever 64 upwardly to a rest position in the absence of forces pivoting the lever downwardly.

Damper mechanism 68 includes a cylindrical housing 72 fixedly secured to pillar 44*f*; a shaft 74 centrally mounted within the housing; a vane structure 76 mounted on the shaft for rotary movement with the shaft within the housing, a gear 78 mounted on a free end of shaft 74 exteriorly of the housing 72 and meshingly engaging with gear segment portion 64*f* of lever 64, and a viscous fluid 80 positioned within the housing in surrounding relation to vane 76. It will be seen that pivotal movement of lever 64 about axis 49 has the effect of rotating gear 78 whereby to rotate vane 76 within housing 72 against the viscous resistance of fluid 80 so as to provide a viscous damping resistance to the pivotal movement of lever 64.

In the operation of the invention door handle assembly, either the outside door handle may be pivoted to unlatch the latch 28 or the inside door handle may be pivoted to unlatch the latch 28, the opening movement of the respective handle in each case not disturbing the other handle by virtue of the lost motion connections provided at the common latch actuator assembly 40. Specifically, as the outside door handle is pivoted outwardly to an unlatching position, handle arm 42*b* engages pin 48 to pivot lever 46 about axis 49. As lever 46 is pivoted about axis 49, arcuate driver portion 46*d* of lever 46 engages an end face 64*h* of arcuate driver portion 64*e* of lever 64 to pivot lever 64 downwardly and move rod 70 downwardly in a manner to unlatch latch 28. As the lever 64 is pivoted downwardly, the upper end 58*a* of cable 58 slides in a lost motion manner in mounting structure 64*h* so as not to disturb the inside door handle assembly.

Conversely, when inside door handle 50 is pivoted outwardly to unlatch the latch, cable 58 pulls lever 64 downwardly by virtue of cable head end 58*b* to move rod 70 downwardly in an unlatching direction. As the lever moves downwardly the leading face 64*i* of arcuate driver 64*e* moves in an idling, lost motion manner within the gap 80 defined between the trailing face 46*f* of driver segment 46*d* and the leading face 64*i* of arcuate driver 64*e* to ensure that the opening movement of the inner door handle does not disturb the outer door handle.

As lever 64 is pivoted downwardly to unlatch the latch in response to either opening movement of the outside door handle or opening movement of the inside door handle, spring 66 resiliently resists the downward movement to provide a positive "feel" for the opening movement of the respective handle and the spring acts in response to release of the respective handle to positively return the handle to its rest position by exerting an upward pivotal force against lever 64. Further, as lever 64 is pivoted downwardly or upwardly about axis 49, damper mechanism 68 acts to provide a damping force resisting the latching or unlatching movement of the mechanism, thereby to cushion the latching and unlatching movement of the mechanism and in particular to mollify the return movement of the inside door handle and the outside door handle upon release of the handle to preclude objectionable slapping noises as the handle resumes its rest position with respect to the respective housing.

The invention door handle assembly, by providing many common elements in the outside door handle linkage assembly and the inside door handle linkage assembly, significantly reduces the cost of the system without any sacrifice in the performance of the system. Specifically, the use of a common latch actuator assembly allows the use of a common spring to provide spring biased movement of both the inside and outside door handles and the common latch actuator arrangement further allow the provision of a common damping mechanism to provide a damping action with respect to the closing movement of both the inside and outside door handles. The overall effect of the invention is to provide a total inside/outside door handle assembly for a motor vehicle having performance equal to or superior to prior art systems employing individual inside and outside linkages and at a price that is significantly less than the combined price of the inside and outside door handle assemblies by virtue of both reduced parts costs and reduced labor costs.

Whereas a preferred embodiment of the invention has been illustrated and described in detail, it will be apparent that the various changes may be made in the disclosed embodiment without departing from the scope or spirit of the invention.

What is claimed is:

1. A motor vehicle door handle assembly comprising an outside door handle movable between latched and unlatched positions, an outside door handle linkage for connecting the outside door handle to a door latch, an inside door handle movable between latched and unlatched positions, and an inside door handle linkage for connecting the inside door handle to the door latch, characterized in that:

the outside and inside door handle linkages share a common damper element which is interposed in each linkage and acts to cushion the movement of the inside and outside door handles.

2. A motor vehicle door handle assembly according to claim 1 wherein the assembly further includes a lost motion connection allowing movement of either door handle to an open position without corresponding opening movement of the other door handle.

3. A motor vehicle door handle assembly according to claim 1 wherein:

the outside door handle and the inside door handle further share a common latch actuator element and a common linkage element for interconnecting the latch actuator element and the latch; and the common latch actuator element is moved to actuate the common linkage element and thereby actuate the latch in response to opening movement of either the outside door handle or the inside door handle.

4. A motor vehicle door handle assembly according to claim 3 wherein the assembly further includes lost motion means allowing movement of the common latch actuator element in response to opening movement of either handle without corresponding opening movement of the other handle.

5. A motor vehicle door handle assembly according to claim 4 wherein the assembly further includes a common spring arranged to resist movement of the common latch actuator element.

6. A motor vehicle door handle assembly comprising an outside door handle, an outside door handle linkage for connecting the outside door handle to a door latch, an inside door handle, and an inside door handle linkage for connecting the inside door handle to the door latch, characterized in that:

the outside and inside door handle linkages share a common spring element which is interposed in each linkage and acts to yieldably resist opening movement of the inside and outside door handles and provide a spring biased return movement of the inside and outside door handles upon release of the handle;

the outside door handle and inside door handle further share a common latch actuator element and a common linkage element for interconnecting the latch actuator element and the latch;

the common latch actuator element is moved to actuate the common linkage element and thereby actuate the latch in response to opening movement of either of the outside door handle or the inside door handle;

the assembly further includes lost motion means allowing movement of the common latch actuator element in response to opening movement of either handle without corresponding opening movement of the other handle;

the spring is arranged to resist movement of the common latch actuator element;

the common latch actuator element is configured to define first gear means; and the assembly further includes a damper mechanism including second gear means meshing with said first gear means and a damper element driven by the second gear means.

7. A motor vehicle door handle assembly according to claim 6 wherein:

the common latch actuator element comprises a common lever pivoted at one end thereof about a pivot axis; and the common linkage element interconnects a free end of the common lever and the latch.

8. A motor vehicle door handle assembly according to claim 7 wherein:

the common lever is configured proximate said one end thereof to define said first gear means centered on said pivot axis;

said second gear means is mounted for rotary movement in response to pivotal movement of the common lever;

the damper mechanism further includes a fixed housing;

the damper element comprises a vane structure mounted for rotary movement in the housing in response to rotary movement of the second gear means; and a viscous fluid is trapped in the housing to resist the rotary movement of the vane structure in the housing.

9. A motor vehicle door handle assembly according to claim 8 wherein:

the outside door handle linkage includes a lever mounted at one end thereof for pivotal movement about said axis in response to opening movement of the outside door handle; and the lost motion means includes a lost motion connection between said one end of said common lever and said one end of said outside door handle linkage lever.

10. A motor vehicle door handle assembly comprising an outside door handle, an outside door handle linkage connecting the outside door handle to a door latch, an inside door handle, and an inside door handle linkage connecting the inside door handle to the door latch, characterized in that:

the outside and inside door handle linkages are operatively connected at a location remote from the latch and share a common linkage element extending from the remote location to the latch;

one of said linkages includes a cable extending from the respective handle to the remote location;

the operative connection at the remote location includes lost motion means operative to allow opening movement of the outside door handle without disturbing the inside door handle and opening movement of the inside door handle without disturbing the outside door handle;

said one linkage comprises the inside door handle linkage;

the outside door handle linkage includes a first lever pivotally mounted at one end thereof proximate the remote location for pivotal movement about a fixed axis and operatively connected proximate a free end thereof to the outside door handle;

the assembly further includes a second lever pivotally mounted at one end thereof on said fixed axis and operatively connected to said cable and to the shared common linkage element; and the lost motion means includes a first lost motion connection between the one end of the first and second levers operative to allow relative pivotal movement between the levers.

11. A motor vehicle door handle assembly according to claim 10 wherein the first lost motion means provides a driving connection between the levers in response to opening movement of the outside door handle and allows relative movement between the levers in response to opening movement of the inside door handle so as not to disturb the outside door handle.

12. A motor vehicle door handle assembly according to claim 11 wherein the lost motion means further includes a second lost motion connection between the second lever and the inside door handle whereby pivoting of the second lever in response to opening movement of the outside door handle does not disturb the inside door handle.

13. A motor vehicle door handle assembly according to claim 12 wherein:

the second lost motion connection comprises a mounting structure on the second lever remote from the pivot axis slidably receiving one end of the cable; and the one end of the cable is headed so as allow unlatching movement of the second lever in response to opening movement of the inside door handle while not disturbing the inside door handle in response to unlatching movement of the second lever in response to opening movement of the outside door handle.

14. A motor vehicle door handle assembly comprising an outside door handle, an outside door handle linkage connecting the outside door handle to a door latch, an inside door handle, and an inside door handle linkage connecting the inside door handle to the door latch, characterized in that:

the outside and inside door handle linkages are operatively connected at a location remote from the latch and share a common linkage element extending from the remote location to the latch;

the operative connection at the remote location includes lost motion means operative to allow opening movement of the outside door handle without disturbing the inside door handle and opening movement of the inside door handle without disturbing the outside door handle;

the outside door handle linkage includes a first lever pivotally mounted at one end thereof proximate the remote location for pivotal movement about a fixed axis and operatively connected proximate a free end thereof to the outside door handle;

the assembly further includes a second lever pivotally mounted at one end thereof on said fixed axis and operatively connected to the inside door handle and to the shared common linkage element;

the lost motion means includes a first lost motion connection between the one end of the first and second levers operative to allow relative pivotal movement between the levers; and the assembly further includes a coil spring positioned on said fixed axis and operative to resiliently resist opening movement of said inside door handle and said outside door handle and provide a positive return of each door handle to a closed position following release of the handle.

15. A motor vehicle door handle assembly according to claim 14 wherein:

the second lever includes a spring mount hub portion concentric with said axis: and the coil spring is mounted on said spring mount hub portion, is anchored at one end thereof, and engages at another end thereof with the second lever.

16. A motor vehicle door handle assembly according to claim 15 wherein the assembly further includes a damper mechanism including a housing, a vane rotatable in the housing, a viscous fluid trapped in the housing, and drive means operative to rotate the vane in the housing against the resistance of the viscous fluid in response to pivotal movement of the second lever.

17. A motor vehicle door handle assembly according to claim 16 wherein:

the second lever includes gear teeth centered on said fixed axis; and said damper mechanism drive means comprises a gear connected to said vane and meshing with said gear teeth whereby pivotal movement of said second lever rotates said vane in said housing.

18. A motor vehicle door handle assembly comprising an outside door handle, an outside door handle linkage connecting the outside door handle to a door latch, an inside door handle, and an inside door handle linkage connecting the inside door handle to the door latch, characterized in that:

the outside and inside door handle linkages are operatively connected at a location remote from the latch and share a common linkage element extending from the remote location to the latch;

the outside and inside door handle linkages further share a common spring element which is interposed in each linkage proximate the remote location and which acts to yieldably resist opening movement of the inside and outside door handles and provide a spring biased return movement of the inside and outside door handles upon release of the handles;

the assembly includes a common latch actuator element positioned at said remote location and movable to unlatch the latch in response to opening movement of either the inside door handle or the outside door handle;

the common spring element resiliently resists movement of the common latch actuator element in an unlatching direction in response to opening movement of the outside door handle or the inside door handle and returns the common latch actuator to a rest position upon release of the actuated handle;

the common latch actuator element comprises a latch lever mounted for pivotal movement about a fixed axis;

the common spring element comprises a coil spring centered on said axis and resisting movement of the latch lever in an unlatching direction; and the assembly further includes a common damper mechanism including a housing containing a viscous fluid and a vane movable in the housing against the resistance of the viscous fluid in response to pivotal movement of the latch lever.

19. A motor vehicle door handle assembly according to claim 18 wherein:

the common damper mechanism further includes a gear driving said vane; and the latch lever includes gear teeth formed on said lever concentric with said axis and driving said gear.

20. A motor vehicle door handle assembly comprising an outside door handle, an outside door handle linkage for connecting the outside door handle to a door latch, an inside door handle, and an inside door handle linkage for connecting the inside door handle to the door latch, characterized in that:

the outside and inside door handle linkages share a common spring element which is interposed in each linkage and acts to yieldably resist opening movement of the inside and outside door handles and provide a spring biased return movement of the inside and outside door handles upon release of the handle; and the outside and inside door handle linkages further share a common damper mechanism which is interposed in each linkage and acts to cushion the spring biased return movement of the door handles.

21. A motor vehicle door handle assembly comprising an outside door handle, an outside door handle linkage connecting the outside door handle to a door latch, an inside door handle, and an inside door handle linkage connecting the inside door handle to the door latch, characterized in that:

the outside and inside door handle linkages are operatively connected at a location remote from the latch and share a common linkage element extending from the remote location to the latch;

the outside and inside door handle linkages further share a common spring element which is interposed in each linkage proximate the remote location and which acts to yieldably resist opening movement of the inside and outside door handles and provide a spring biased return movement of the inside and outside door handles upon release of the handles; and the outside and inside door handle linkages further share a common damper mechanism which is interposed in each linkage proximate the remote location and which acts to cushion the spring biased return movement of the door handles.

* * * * *